US005768706A

United States Patent [19]

Griffith et al.

[11] Patent Number: 5,768,706

[45] Date of Patent: Jun. 23, 1998

[54] MIDI WEIGHTED JACKET

[76] Inventors: Charles L. Griffith; Antoinette Bacchus Griffith, both of 4316 Saugus Dr., Grand Prairie, Tex. 75052

[21] Appl. No.: 643,382

[22] Filed: May 6, 1996

[51] Int. Cl.[6] ..... A41D 1/04

[52] U.S. Cl. ..... 2/102; 2/247; 482/105

[58] Field of Search ..... 2/102, 94, 69, 2/51, 92, 247, 250, 251, 93, 108, 103; 482/105, 124

[56] References Cited

U.S. PATENT DOCUMENTS

| | | | |
|---|---|---|---|
| 1,152,854 | 9/1915 | Simpson | 2/51 |
| 4,268,917 | 5/1981 | Massey | 2/102 |
| 4,302,847 | 12/1981 | Miles | 2/2 |
| 4,332,379 | 6/1982 | Bannister | 272/119 |
| 4,344,620 | 8/1982 | Debski | 272/119 |
| 4,382,302 | 5/1983 | Watson | 2/102 |
| 4,384,369 | 5/1983 | Prince | 2/79 |
| 4,394,012 | 7/1983 | Egbert et al. | 272/119 |
| 4,407,497 | 10/1983 | Gracie | 272/119 |
| 4,601,067 | 7/1986 | Buonassissi | 2/102 |
| 4,602,387 | 7/1986 | Zakrzewski | 482/105 |
| 4,658,442 | 4/1987 | Tomlinson et al. | 2/94 |
| 4,946,453 | 8/1990 | Monson | 604/312 |
| 4,953,856 | 9/1990 | Fox, III | 272/109 |
| 4,989,267 | 2/1991 | Watson | 2/102 |
| 5,002,270 | 3/1991 | Shine | 272/119 |
| 5,010,596 | 4/1991 | Brown et al. | 2/228 |
| 5,144,694 | 9/1992 | Daoud et al. | 2/69 |
| 5,440,761 | 8/1995 | Abrams et al. | 2/94 |
| 5,465,425 | 11/1995 | Crispin | 2/94 |
| 5,555,562 | 9/1996 | Holt et al. | 482/105 |

*Primary Examiner*—Amy B. Vanatta

[57] ABSTRACT

A midi weighted jacket to be worn above the breastline by athletes and healthy persons during various exercises and comprised of a front panel, back panel, shoulder panel and no sides for improving the physical fitness and general posture of a wearer over time through specific exercises. The jacket is comprised of a plurality of pockets in the front panel, back panel and shoulder panel, with each of the pockets comprising secured openings for admitting and removing weights. The jacket is equipped with a rectangular opening located about the neck area where the front panel integrally connects to the back panel, to facilitate easy access for head and neck entry, during attachment and removal of the jacket from the shoulder. The jacket is also comprised of a shoulder panel that is connected to the front panel and back panel.

20 Claims, 11 Drawing Sheets

MIDI WEIGHTED JACKET

BACKGROUND OF THE INVENTION

The present invention relates generally to an exercise device which incorporates varying static loads at and below the outer shoulder, over the chest above the breast line and over the upperback over the upper shoulder blade, during participation in various athletic activities such as running, walking, tennis, football, soccer, rugby, skiing, skating etc.

Athletes are constantly searching for different approaches and devices to increase performance during the execution of their specific event. This has resulted in considerable effort directed towards enhancing their capabilities, by use of weights attached to their bodies, ankles, wrists, chests, over their shoulders, and complete jogging and numerous styles of weighted jackets.

U.S. Pat. No. 4,268,917 to Massey and dated May 1981 describes a variably weighted vest that is full bodied, loose fitting and closed at the sides by short rows of stitches. The vest is intended to be used by healthy persons engaged in exercise, and also contains a plurality of vertically extending long pockets which extends on each side of the front of the garment and also across the back of the garment. The pockets had to be filled with dense granular material such as sand, coins and stones. However, the vests worn by males are different to those worn by women, in that a segment of the weights in the vicinity of the women breast is removed.

U.S. Pat. No. 4,302,847 to Miles and dated December 1981 describes an adjustable, zippered, and full body protective vest, which provides body protection to a person participating in sports, in which the torso may be subject to impact. The vest was not designed to aid in cardiovascular, cardiomuscular, neuromuscular and bone stimulation, because the primary objective of this device is to protect the lower back and hip from impact injuries.

U.S. Pat. No. 4,332,379 to Bannister and dated June 1982 describes a collapsible, back pack type training device which could be worn by a person during exercises. The device is equipped with a second compartment that is flexible, and can dispose of the weighting material, contained also in the very second compartment. This device is uncomfortable for jogging since it is loaded only along the center of the back, and imposes excessive stress to the lower lumbar muscles. Another disadvantage of this device is that the weight materials had to be removed from the device, to facilitate easy transport when it is emptied.

U.S. Pat. No. 4,344,620 to Debski and dated August 1982 describes a full body, interconnected water and air tight vest that could be used by an exerciser. The vest is supported from the shoulder, and is also said to have the ability to maintain the shape of varying quantities of weights, despite the change in their magnitudes. This vest is extremely bulky, lacks aesthetic appeal, and requires the application/involvement of two unit operations such as filling with water and then air, prior to use, if the contents are previously removed. This vest is easily render useless if there are leaks in system enclosing both the water and the air.

U.S. Pat. No. 4,382,302 to Watson and dated May 1983 describes a full body, sufficiently rigid weighted vest to be worn by athletes to increase running strength, speed and endurance. The vest comprise of front and rear panels adapted to be worn upon an athlete's respectively chest and back. A plurality of easily detachable weights may be affixed to the vest as the user desires. A major disadvantage in using this vest is that it has a rigid front which does not follow the wearer's body contour. Yet another disadvantage with respect to using this vest is that the weights project outwards from the vest and have sharp edges and curves.

U.S. Pat. No. 4,384,369 to Prince and dated May 1983 describes an exercise suit with jacket and pants containing numerous insulated constructed pockets to carry a liquid. The suit is claimed to provide massage stimulation to muscles during body movement, carry varying loads which may be evenly distributed about the users body during exercises, reduces body heat loss during cold weather and well suited for mass fabrication techniques. A major disadvantage of this suit is that there is a lack in cohesive shape in the liquid, since it shifts as the wearer engages in physical exercises as running, skipping and others. This shifting of the weights produces various degrees of imbalance in the wearer's stability during the said exercises.

U.S. Pat. No. 4,394,012 to Egbert et al. and dated July 1983 describes an open front overlapping exercise vest with two strap means of securing the vest around the chest, back and shoulders of the user. The straps are located about the sternum and also about the left bust line below the heart region. The difference between the front and back design feature for the said device is, the back contains no mechanism for securing the entire device to the wearer, whereas with respect to the front, two hook, tape and loop straps are located above and below the sternum. However, this device does not provide for true symmetrical application of weights with respect to front, back and diagonally, since the front and back structures do not have similar designs to accommodate the weights, in a symmetrical fashion.

U.S. Pat. No. 4,407,497 to Gracie and dated October 1983 describes a weighted exercise suit of swim suit style, that allows for the removal and addition of weights prior to exercising. The weights are adapted to two receptacles, each of which extends over the left and right shoulders from back waist line to front waist line. However, the exercise suit worn by males are different to those worn by women, in that a segment of the weights in the vicinity of the women breast is removed, and thus providing for the attachment of weights extending from the said women upper back, over the shoulder and terminating on the breast bone, almost inline with the sternum.

U.S. Pat. No. 4,601,067 to Buonassissi and dated July 1986 describes a full body vest structure with pockets for receiving cool or warm packs. The vest is said to keep a person's upper body cool during hot periods, or warm during cold periods. The vest was not designed to aid in cardiovascular, cardiomuscular, neuromuscular and bone stimulation, because the primary objective of this device, is to air condition the wearer's body with respect to the ambient thermal condition, in which the wearer may be located.

U.S. Pat. No. 4,658,442 to Tomlinson et al. and dated April 1987 describes a full body open front variable weight vest for exercising. The vest comprises of a back panel, front right and front left panels. Each of the two front panels and the single back panel are connected by corresponding integral straps at the shoulder, and elastic means between the region of the bust and waist. A disadvantage associated with the vest is the thin sheet lead weight has to be bent into shape by the wearer to fit said wearer body contour. A wearer may have to break his or her exercise rhythm to engage in periodic physical adjustments to the lead weights prior to proceeding on to the next exercise. Another disadvantage of using this vest is, considerable quantity of padding is needed around the above mentioned thin sheet lead weight, to prevent bruises from occurring on the wearer's body, during dynamic exercises.

U.S. Pat. No. 4,946,453 to Monson and dated August 1990 describes a full body weight reducing garment which focuses on weight loss of specific areas of the body. The garment utilizes neoprene for insulation and LYCRA™ for ventilation. That portion of the body which is covered with neoprene prevents perspiration from evaporating from that specific area of the surface of the body, whereas those covered with lycra facilitate perspiration. A disadvantage in using this body weight reducing garment, is that a potential exists for dehydration of the wearer, if the LYCRA™ fabric is not woven.

U.S. Pat. No. 4,953,856 to Fox, III and dated September 1990 describes an exercise garment comprising a waistband, thigh and calf attachments for the lower extremities of a wearer, as well as a spinal, shoulder and elbow elements constitute the contraption for the upper body. The exercise garment is said to improve running and walking form. A major disadvantage of this exercise garment is that after it is initially attached to the wearer's body, the additional attachments that have to be made before the garment is ready for use by the wearer, are, a total of three for the lower body portion and a total of four for the upper body portion. These many already mentioned connections associated with this garment are time consuming to install, before effective use can be made of this exercise garment. This garment is bulky and therefore not very easy to install before use.

U.S. Pat. No. 4,989,267 to Watson and dated February 1991 describes a full body weighted training vest with front and rear flexible panels which fits against the athletes back and chest. The panels include a plurality of pockets to receive a plurality of weights when needed by the user. The front and rear panels are held together by a belt located at the waist of the garment.

U.S. Pat. No. 5,002,270 to Shine and dated March 1991 describes a full body open front exercise vest which comprises of front, back, two sides which are joined at the sides by laces. The vest has the ability to receive weights in a 2:1 front to back ratio, within the plurality of pockets, to which the weights can be inserted or removed from the said pockets in varying quantities.

U.S. Pat. No. 5,010,596 to Brown et al. and dated April 1991 describes a variety of garments which includes full body vests, set of shorts and jump suits. With respect to the full body vests, a plurality of pouches are situated in the front and back of the garment to receive or remove weights of varying magnitude varying magnitude.

The previously mentioned U.S. Pat. Nos. 4,989,267, 5,002,270, and 5,010,596 granted to respectively Watson, Shine and Brown et al. all possess a common limitation outside the application of free arm exercises during different types of running actions. The before mentioned limitation is manifested, during actual dynamic exercises such as forward running, sideward running and backward running, in which it is not possible to further strengthen the deltoids, tapezoidal, pectorial, latimus dorsi and upper back muscle by loading the muscles with extra weight, whilst utilizing only the devices.

U.S. Pat. No. 5,144,694 to Conrad Da oud et al. and dated September 1992 describes an exercise or physical therapy apparel including a sleeveless vest, pants, spine strap, belt, wrist band, and weight packets. As regards the vest, it is a full body vest with separate right and left shoulder pockets, which extend over the entire shoulder from above the wearer's breast, to over the wearer's shoulder blade. The vest also comprises of two pockets in the general vicinity of the wearer lower rib cage, a pocket over the wearer's sternum, pockets over the wearer's rib cage in the back panel and a spine panel which extends along the spine of the wearer. The plurality of weights in the shoulder, upper back, lower front and back rib cage, sternum, waist and spine packets do not form a continuous system of weights, but rather a single unit for each of the shoulders, upper back, spine, lower front and back rib cage and a separate unit for the sternum. However, the wrist unit and an ankle unit are separate units when compared with the main body unit, and at least two separate pieces of garment have to be handled by the wearer, and this is dependent upon the wearer's choice.

The references cited below are herein incorporated in entirety and disclose garments having weights, therein, and garments which are of a mid-length which extends to the middle of the torso or above: U.S. Pat. Nos. 1,152,854 (Simpson); 4,602,387 (Zakrzewski); 5,440,761 (Abrams et al); 5,465,425 (Crispin) and 5,555,562 (Holt et al).

SUMMARY OF DISCLOSURES

Based upon the above review of the previous art, each of the previous inventions utilize separate garments which may be described as vest or jacket or apparel in conjunction with ankle and wrist weights, to achieve some degree of increased strength, stamina, theraputic performance and general appearance. But each of these devices has its limitations, therefore, a need still exist for a midi weighted jacket which has significant advantage over the other reported jackets.

The midi weighted jacket which is a single unit, comprises of a front panel, back panel, shoulder panel and no sides. No prior art structurally recognized a single jacket or single vest with front panel, back panel and shoulder panel, with the shoulder panel comprising a flexible arrangement to adopt outer and upper arm deltoid weights, to stimulate the deltoids, tapezoidal, pectoral, latimus dorsi and upper back muscles during certain dynamic exercises, such as forward running, sideward running and backward running, to increase speed and strength of the wearer.

No prior art functionally recognized a single jacket or single vest with front panel, back panel, shoulder panel and no sides, with the shoulder panel comprising a flexible arrangement to adopt outer and upper arm deltoid weights, to stimulate the deltoids, tapezoidal, pectoral, latimus dorsi and upper back muscles during certain dynamic exercises, such as brisk walking, forward running, sideward running and backward running, to increase speed and strength of the wearer.

No prior art previously suggested a single jacket or single vest with front panel, back panel, shoulder panel and no sides, with the shoulder panel comprising a flexible arrangement to adopt outer and upper arm deltoid weights, to stimulate the deltoids, tapezoidal, pectoral, latimus dorsi and upper back muscles during certain dynamic exercises such as brisk walking forward running, sideward running and backward running, to increase speed and strength of the wearer.

No prior art previously identified that there was a need to physically load a single jacket or single vest with front panel, back panel, shoulder panel and no sides, with the shoulder panel comprising a flexible arrangement to adopt outer and upper arm deltoid weights, to stimulate the deltoids, tapezoidal, pectoral, latimus dorsi and upper back muscles during certain dynamic exercises, such as brisk walking, forward running, sideward running and backward running, to increase speed and strength of the wearer.

No prior art previously provided a solution to satisfy the need to physically load a single jacket or single vest with front panel, back panel, shoulder panel and no sides, with the shoulder panel comprising a flexible arrangement to adopt outer and upper arm deltoid weights, to stimulate the deltoids, tapezoidal, pectoral, latimus dorsi and upper back muscles during certain dynamic exercises such as brisk walking, forward running, sideward running and backward running, to increase speed and strength of the wearer.

The main advantage of the midi weighted jacket not contained and appreciated by prior art, is that it is a single jacket with front panel, back panel, shoulder panel and no sides, with the shoulder panel comprising a flexible arrangement to adopt outer and upper arm deltoid weights, to stimulate the deltoids, tapezoidal, pectoral, latimus dorsi and upper back muscles during certain dynamic exercises such as brisk walking, forward running, sideward running and backward running, to increase speed and strength of the wearer.

Athletes such as sprinters, football and rugby players need to possess the ability to explode instantaneously during forward running, sideward running and backward running, but at present, are deprived the benefit of using a midi weighted jacket, to provide additional loading to the deltoids, tapezoidal, pectoral, latimus dorsi and upper back muscles during actual practice sessions. It is interesting to note that instantaneous explosive sprinting, dictates that the rapid actions of the feet, have to be counter balanced by upper body strength, involving a complex interaction among the trapezoidal, deltoids, pectorials and latimus dorsi muscles. It therefore follows that the midi weighted jacket provides the solution to satisfy this need for the athletes.

A review of chain stores and physical fitness retail establishments public inventory, revealed that only mostly ankle and wrist weights are available for athletes and citizenry commercial consumption. The arena with respect to commercial availability of a well constructed single weighted device, is practically non existent.

The midi weighted jacket is an easy to manufacture single device without complicated, cumbersome and mechanical parts.

The midi weighted jacket easily attached to, and removed by the wearer, without discomfort.

The midi weighted jacket could be worn by a wearer irrespective of sex, and will provide for cardiovascular, cardiomuscular, and neuromuscular stimulation.

The midi weighted jacket is comfortable during different types of running, jogging and walking and would aid in the strengthening the muscles, in the wearer's lumbar region.

The midi weighted jacket is not bulky, has regular apparel appearance, and does not require the use of water and air, and therefore, is not susceptible to hydraulic and pneumatic leaks.

The midi weighted jacket does not have a rigid front panel and is readily adaptable to fit the wearer's body contour.

The midi weighted jacket fits snugly to the wearer's body in such a fashion that the weights do not shift in significant amplitude, to produce imbalance which will result in wearer's instability.

The midi weighted jacket when attached to the wearer's body is truly symmetrical with respect to back panel and front panel, and also from right side to left side of the wearer.

The midi weighted jacket when attached to the wearer's body is truly symmetrical with respect to the left and right shoulder panels.

The midi weighted jacket does not utilize rigid and malleable weights, which has to be deformed periodically to fit the wearer's body contours, prior to use.

The midi weighted jacket when used by the wearer in the proper snug fit manner, does not initiate bruises to the body of the wearer, and therefore does not require excessive or additional padding during use.

The midi weighted jacket does not have the potential to cause dehydration to the wearer, relative to the surface area of the covered portion of the wearer's body, and because of the type of material used to construct the jacket.

The midi weighted jacket can be fully attached to the wearer in less than one minute, because of the lack of bulkiness and handling of many pieces. It is obvious that the fewer pieces a wearer has to handle, will essentially increase the time element efficiency during body attachment and removal. The increase in body attachment and removal efficiencies of the jacket has resulted in the midi weighted jacket possessing a superior operational capability, compared to most of those jackets associated with the previous art.

The midi weighted jacket is easy to transport.

The midi weighted jacket is easily transferable from one wearer to another, with minimum elapsed time between the said transfer, as may be required by those institutions or families that only have few units for athletic use.

The advance of the midi weighted jacket will be a significant contribution to the field of physical fitness, especially with respect to, user friendly, eye appealing devices, which may be worn on the body, during various dynamic and aerobic exercises.

An extensive review of the prior art also revealed that the midi weighted jacket is unique in features and was never specifically suggested by any single prior art. However, prior art references do have some of the individual elements as single or combined units, that could not be combined physically, without major redesign of structural features, which will entail removal, reconfiguration and additions, hence, could not have functional utility as the jacket.

The general aspect of the present invention, is a midi weighted jacket be worn over the wearer's garment, above the breastline, and may be used for physical conditioning of a healthy person or athlete.

Embodiments of the present invention comprises of a front panel, back panel, shoulder panel, and no sides.

A further embodiment of the present invention comprises a shoulder panel which is capable of accommodating weight packets on the outside of, about and between the deltoids area of the shoulder, and above the elbow.

Another embodiment of the present invention comprises weight packets which are slightly elliptical across the shorter, with respect to the longer side of the rectangular and elongated packet. The material to fill the packets comprise dense constituents such as lead, lead alloy material of similar or greater density. The material is permanently placed in a sealed flexible impervious enclosure such as polymer and the like, after which the enclosure is placed in a predetermined multi-stitched sealed fabric sack, constructed from cloth, canvas, nylon, and flexible leather.

Another embodiment of the present invention comprises means of accommodating weight packets located over the chest, between the collar bone and above the breast line. It is believed that increasing the resistance to upward and outward movement of the thorax cavity, of a wearer, by adding load to the breast bone area of the thorax cavity will enhance the breathing capabilities of the wearer, by frequent timely use.

A further embodiment of the present invention comprises of means of accommodating weight packets in the back panel which are located over the upper back, and just below the trapezoidal muscle. Weight packets associated with the back panel provide a symmetrical balance for those associated with the front panel.

Another embodiment of the present invention comprises a shoulder panel, which is integrally connected to the shoulder piece. It is contemplated that other embodiments may employ other shoulder piece to shoulder panel connections, such as the use of hook, tape and loop fasteners, zippers, buttons, laces, studs and other means without deviating from the present invention.

Another embodiment of the present invention comprises a shoulder panel, which is stitched connected to the shoulder piece. It is contemplated that other embodiments may employ other shoulder piece to shoulder panel connections, such as the use of hook, tape and loop fasteners, zippers, buttons, laces, studs and other means without deviating from the present invention.

Another embodiment of the present invention comprises a shoulder panel, which is not stitched connected to the shoulder piece. It is contemplated that other embodiments may employ other shoulder piece to shoulder panel connections, such as the use of hook, tape and loop fasteners, zippers, buttons, laces, studs and other means without deviating from the present invention.

Yet another embodiment of the present invention comprise a shoulder panel means of accommodating weight packets over and about the outside the section of the deltoid muscle above the elbow. The weight packets may extend to the regions about the biceps and triceps muscles. In addition to placing weights in the front and back panels of the jacket, the placement of weights in the shoulder panel provides more stimulation by virtue of increased loading to the deltoids, tapezoidal, pectoral, latimus dorsi and upper back muscles.

Still another embodiment of the present invention comprises means of securing the front panel to the back panel at the region about the right and left bust line by use of hook, tape and loop fastening mechanism or similar fastening arrangement.

Still a further embodiment of the present invention comprises weight packets which are enclosed in a non cumbersome flexible sack in the front panel. Because of the degree of bend in the attached weights, the entire weight packet assumes the shape of the wearer's body contours.

Still a further embodiment of the present invention comprises weight packets which are enclosed in a non cumbersome flexible sack in the back panel. Because of the degree of bend in the attached weights, the entire weight packet assumes the shape of the wearer's body contours.

Still other embodiments of the present invention comprises of a rectangular opening at the neck, to facilitate easy access of head and neck attachment and removal of the jacket from the shoulder. It is contemplated that other embodiments may employ other neck configuration, without deviating from the present invention.

Another embodiment of the present invention is the horizontal openings located at the top of the weight pockets, to facilitate the insertion and removal of weight packets, by sliding the packets in respectively downwards and upwards direction, into and out of the pockets.

A further embodiment of the present invention is to improve the wearer physical capabilities over time by brisk walking, running, jogging, lunging, jumping, skipping, goose walking, punching, blocking and rabbit hopping.

Yet another embodiment of the present invention is to improve the posture of the wearer when brisk walking, running, jogging, lunging, jumping, skipping, goose walking, punching, blocking and rabbit hopping.

It is contemplated that another embodiment of the present invention may employ a sleeved jacket with and without high neck, and accommodating the previously described front panel, back panel and shoulder panel. The shoulder panel may omit the means of securing the arm to the shoulder panel.

The front panel, back panel and shoulder panel are equipped with a previously described plurality of pockets, for accommodating and removing previously described weight packets. The pockets are stitched connected to the jacket.

It is also contemplated, without deviating from the present invention, that another embodiment of the present invention may employ stitched enclosures between the front panel and shoulder panel, and again between the back panel and shoulder panel. The enclosures are specifically located in the vicinity of the left and right arm pits, and yet maintain the open side nature of the midi weighted jacket.

It is also contemplated, without deviating from the present invention, that another embodiment of the present invention may employ integral enclosures between the front panel and shoulder panel, and again between the back panel and shoulder panel. The enclosures are specifically located in the vicinity of the left and right arm pits, and yet maintain the open side nature of the midi weighted jacket.

It is also contemplated, without deviating from the present invention, that another embodiment of the present invention may employ other means of inserting and removing the weighted packets from the weight pockets located on the front panel, back panel and shoulder panel. The means of inserting and removing the weighted packets, includes sliding the packets into the weight pockets horizontally from a side opening, as well as through overlapping pieces from the center of the weight pockets.

It is also contemplated, without deviating from the present invention, that another embodiment of the present invention considered another weight packet configuration such as circular.

Many features of the invention will become more vivid as the jacket is described in detail considering the accompanying figures.

BRIEF DESCRIPTION OF DRAWINGS

The drawings presented herein, provide visual representation of features and their arrangements in the construction of this inexpensive and easy to manufacture midi weighted jacket.

DESCRIPTION OF PREFERRED EMBODIMENTS

Figure 1:
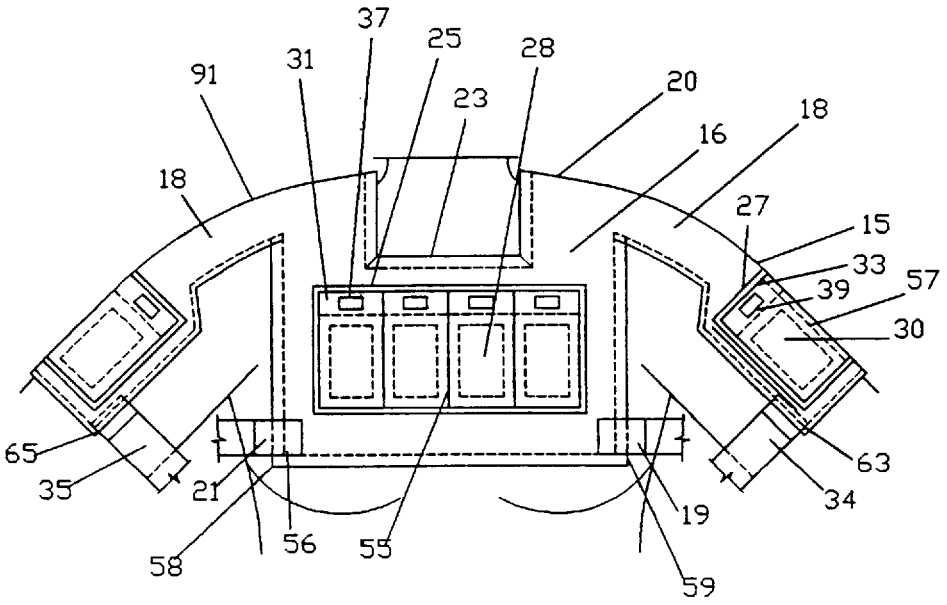
FIG. 1 is a front view of the midi weighted jacket considering horizontal openings.
Figure 2:
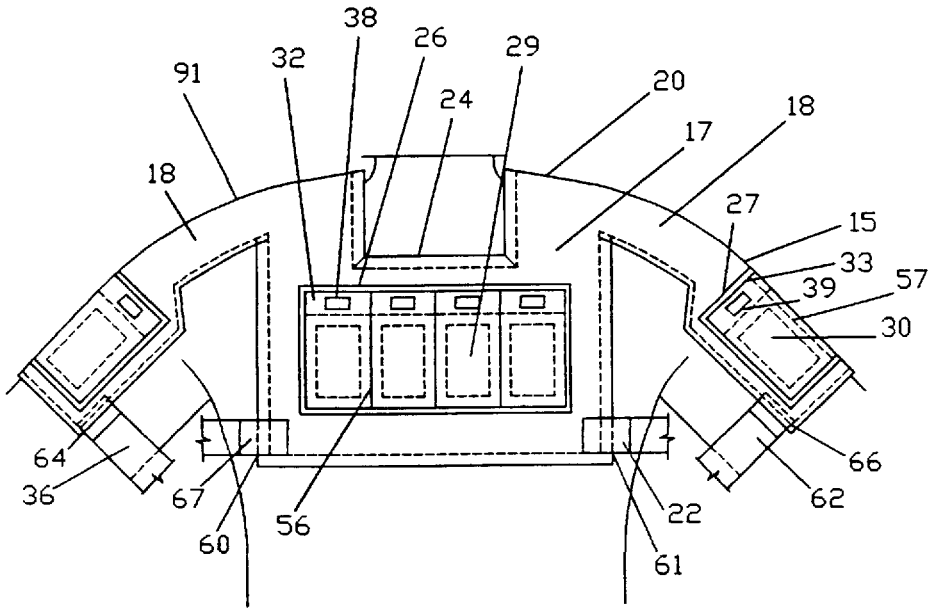
FIG. 2 is a rear view of the midi weighted jacket considering horizontal openings.

The midi weighted jacket 15 has a front panel 16 integrally connected to shoulder panel 18 as shown in FIG. 1. The shoulder panel 18 is also. integrally connected to back panel 17 as shown in FIG. 2. The front panel, back panel and shoulder panel may be formed from a single piece of resilient and easily deformed fabric material, such as high density fabric such as cloth, canvas, nylon, flexible leather. The material may also be of the reflective type, which adds an additional safety feature to the midi weighted jacket, in identifying the wearer in low level lighting environment.

The front panel 16 and back panel 17 are held together in a closed position on the right side of the wearer, and more specifically about the bustline, by two hook and loop fasteners 21 and 22. Fastener 21 is the hook tape segment and fastener 22 is the loop tape segment.

The front panel 16 and back panel 17 are held together in a closed position on the left side of the wearer, and more specifically about the bustline, by two hook and loop fasteners 19 and 67. Hook and loop fastener 19 is the hook tape segment and velcro fastener 67 is the loop tape segment.

Shoulder panel 18 is held together in a closed position on the left upper arm of the wearer, and more specifically about and under the arm pit, by two hook and loop fasteners 34 and 36. Hook and loop fastener 34 is the hook tape segment and hook and loop fastener 36 is the loop tape segment.

Shoulder panel 18 is held together in a closed position on the right upper arm of the wearer, and more specifically about and under the arm pit, by two hook and loop fasteners 35 and 62. Hook and loop fastener 35 is the hook tape segment and hook and loop fastener 62 is the loop tape segment.

Hook tape segments 19 and 21 are respectively stitched connected to the left and right sides of front panel 16 at respectively left and right rectangular points 59 and 58, which are shown in FIG. 1. With respect to back panel 17, loop tape segments 67 and 22 are respectively stitched connected to the left and right sides of the back panel, at respectively left and right rectangular points 60 and 61, which are shown in FIG. 2.

As regards shoulder panel 18, hook and loop fasteners 34 and 36 are respectively stitched connected at respectively front and back arm sections of respective rectangular points 63 and 64. which are shown in FIGS. 1 and 2. Shoulder panel as shown in FIGS. 1 and 2 also show hook and loop fasteners 35 and 62 respectively stitched connected to the front and back arm sections at respective rectangular points 65 and 64.

With respect to hook and loop fasteners 19, 21, 22, 67, 34, 35, 36 and 62, it is contemplated that other means of fastening the front panel 16 to the back panel 17 may utilize loop and buttons, hooks and loops, laces, zippers, loop and studs and other means for opening and closing the pockets.

The front panel 16 and back panel 17 have respectively rectangular shaped openings 23 and 24, connected by shoulder pieces 91 on the left side and 20 on the right side, to form means through which the wearer's head and neck can pass, when attaching or removing the midi weighted jacket.

A plurality of pockets 25, 26 and 27 are respectively stitched attached to the front panel 16, back panel 17 and shoulder panel 18. Each pocket is separated by multiple stitch 55, 56 and 57 for respective front panel 16, back panel 17 and shoulder panel 18. Pockets 25, 26 and 27 receive respectively similar magnitude weight packets 28, 29 and 30, which are shown as hidden lines within each pocket.

Each of the plurality of rectangular shaped, and of same size pockets 25, 26 and 27 are respectively equipped with openings 31, 32 and 33, to insert or remove the weight packets, by respectively sliding the respective packets in the downwards and upwards direction. Openings 31, 32 and 33 are termed horizontal openings. Each of pockets 25, 26 and 27 is also equipped with hook and loop fasteners 37, 38 and 39, which serve as means of opening and closing the pockets, thereby providing additional security, and for preventing the said weight packets from dislodging during dynamic exercise. It is also understood that a single hook and loop fastening strip may be used across all pockets at openings 25, 26 and 27. It is contemplated that other than hook and loop fasteners, such as zippers, loops, hooks, buttons, laces, studs and other means, may be utilized for opening and closing the pockets.

Figure 3:
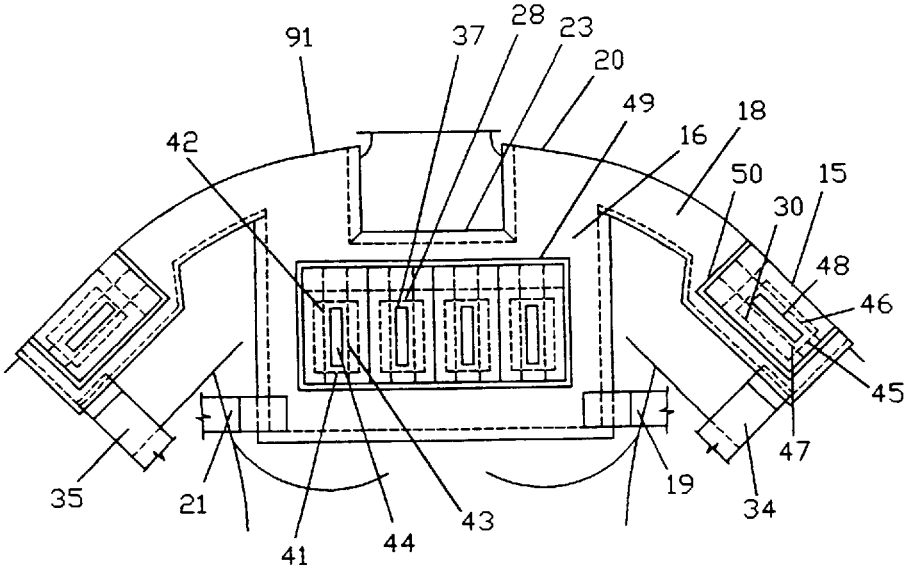
FIG. 3 is a front view of the midi weighted jacket considering vertical openings at the center of the weight pocket.

Another embodiment of the invention is presented in FIG. 3, which describes a midi weighted jacket 15 with front panel 16 and shoulder panel 18 each comprising respectively vertical openings 41 and 45, for weight pockets 49 and 50. The vertical openings comprise overlapping pieces of predetermined dimensions of front panel material, to create edges 42 and 43 for the front panel, and 46 and 47 for the shoulder. The said vertical openings are created about the center of each pocket, to facilitate inserting and removal of weight packets, by respectively sliding the said packets horizontally, through the overlapping pieces, inwards and outwards as the wearer may desire. The overlapping pieces with edges 42 and 43 for the front panel and 46 and 47 for the shoulder panel are respectively secured with hook and loop fasteners 44 for the front panel and 48 for the shoulder panel, in order to prevent the weighted packets from accidentally leaving the rectangular pockets.

Figure 4:
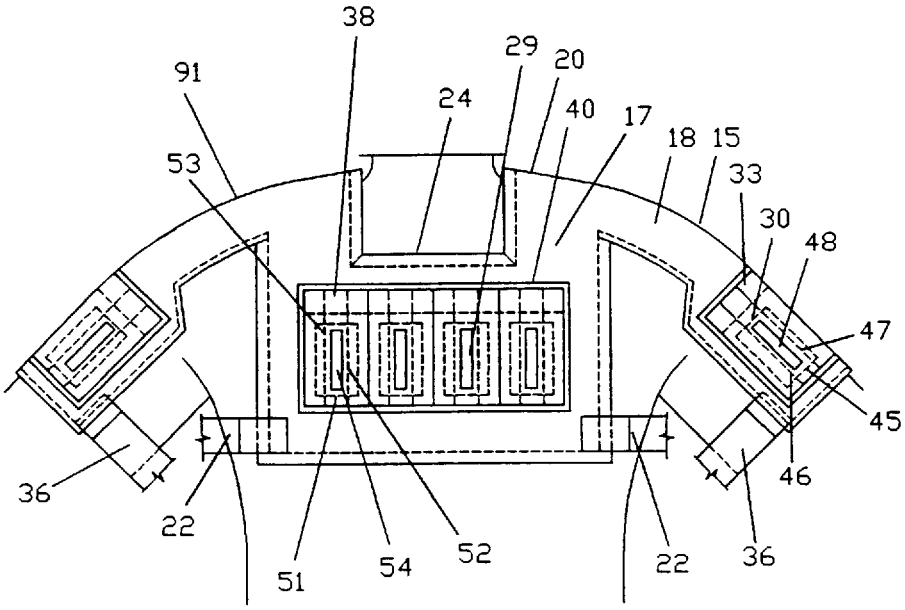
FIG. 4 is a rear view of the midi weighted jacket considering vertical openings at the center of the weight pocket.

FIG. 4 shows the back panel 17 of midi weighted jacket 15 displaying weight pockets 40. The weight pockets comprise of vertical openings 51. The vertical openings comprise overlapping pieces of predetermined dimensions of front panel material, to create edges 52 and 53 for the back panel. The vertical openings are created about the center of each pocket, to facilitate inserting and removal of weight packets, by respectively sliding the packets horizontally, through the overlapping pieces, inwards and outwards as the wearer may desire. The overlapping pieces with edges 52 and 53 for the back panel are secured with hook and loop fasteners 54, in order to prevent the weighted packets from accidentally leaving the rectangular pockets.

It is contemplated that other embodiments may employ other means of closing the openings of the weight pockets, after weighted packets 28, 29 and 30 are respectively inserted or removed from the front panel 16, back panel 17 and shoulder panel 18, such as zippers, loops, hooks, buttons, laces, studs and and the like, without deviating from the present invention.

It is further contemplated that other embodiments may employ other configuration of weighted packets to be utilized by the front panel 16, back panel 17 and shoulder panel 18. The configuration includes circular weighted packets 80 which are shown in FIGS. 9 and 10, as compared to rectangular described herein, without deviating from the present invention.

It is understood that other embodiments considered other means of inserting and removing the weighted packets to the the front panel 16, back panel 17 and shoulder panel 18. The means of inserting and removing the weighted packets, includes sliding the packets into the weight pockets horizontally from a side opening 81, instead of sliding from the center of the weight pockets, in respectively the inwards and outwards directions, for the vertical oriented weight pockets, and again, rather than from the top downwards, as compared to the horizontal orientation; which are described herein, without deviating from the present invention.

Figure 9:
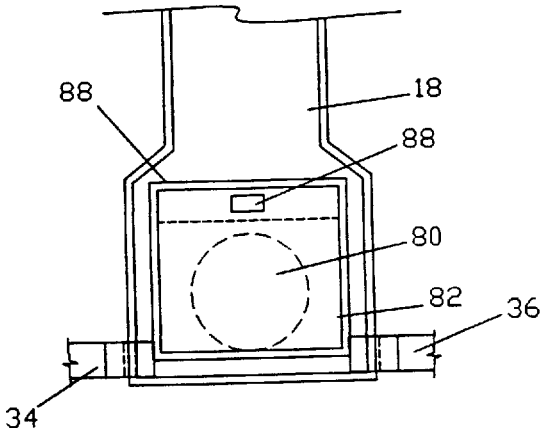
FIG. 9 is a partial front view of the shoulder panel, with circular weight packet contained in weight pocket, oriented in a vertical position.

FIG. 9 shows a segment of the shoulder panel 18, with circular weight packet 80 contained in weight pocket 82 oriented in a vertical position, with horizontal opening 83 for receiving or removing the packet from the top. FIG. 10 shows a segment of the shoulder panel 18, with circular weight packet 80 contained in weight pocket 84, oriented in a horizontal position, so that the packet, could easily be inserted or removed from the pocket, from a side opening 81, by sliding the packet in a horizontal and inward direction, into the pocket. FIG. 11 shows a segment of the shoulder panel 18, with rectangular weight packet 85 contained in weight pocket 86, oriented in a horizontal position, so that the packet, could easily be inserted or removed from the pocket, from a side opening 87, by sliding the packet in a horizontal and inward direction, into the pocket.

Figure 10:
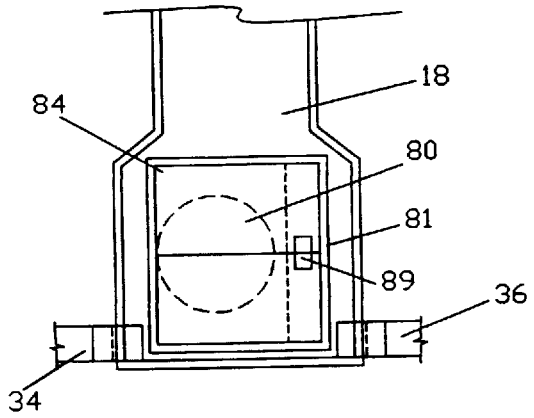
FIG. 10 is a partial front view of the shoulder panel, with circular weight packet contained in weight pocket, oriented in a side opening position.
Figure 11:
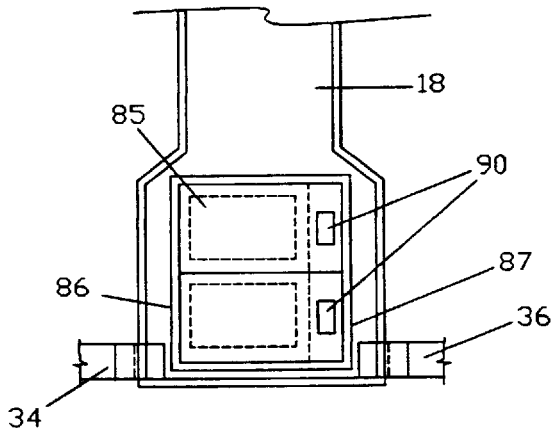
FIG. 11 is a partial front view of the shoulder panel, with rectangular weight packet contained in weight pocket, oriented in a side opening position.

Each of the weight pockets 82, 84 and 86 which is shown in FIGS. 9, 10 and 11, is also equipped with hook and loop fasteners 88, 89 and 90, which serve as means of opening and closing the pockets, thereby providing additional security, and for preventing the weight packets from dislodging during dynamic exercise. It is also understood that a single hook and loop fastening strip may be used across all pockets at openings 83, 81 and 87. It is contemplated that other than hook and loop fasteners, such as zippers, buttons, laces, studs and other means, may be utilized for opening and closing the pockets.

It is further understood that other embodiments considered other curvilinear edges for other points and rectangular points 58, 59, 63, and 65 as shown in FIG. 1, as well as 60, 61, 64, and 66 as shown in FIG. 2, without deviating from the present invention. The enclosure still allows the midi weighted jacket to maintain the no sides nature.

Figure 5:
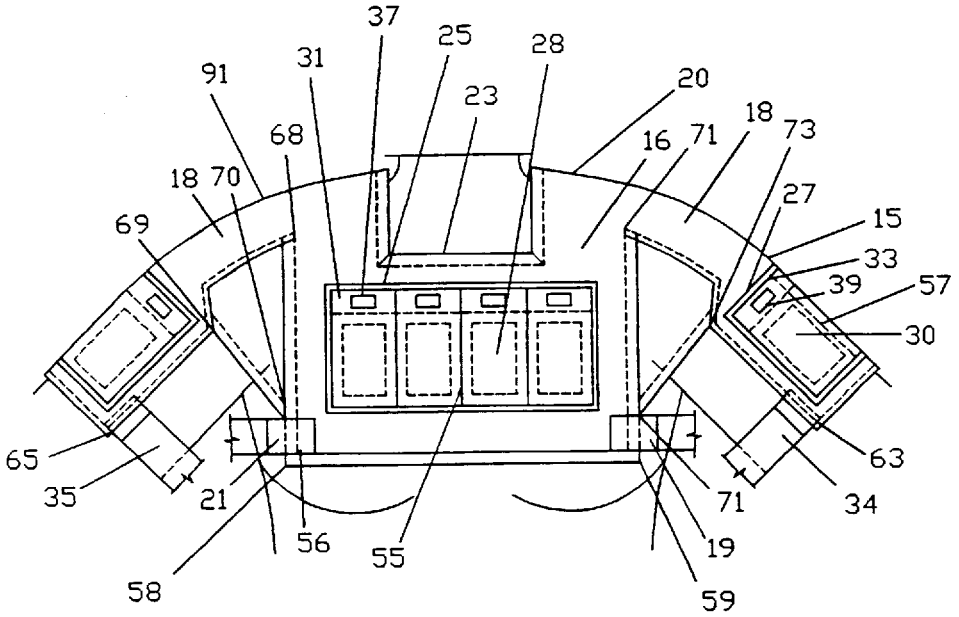
FIG. 5 is a front view of the midi weighted jacket, with stitched enclosure between the front panel and shoulder panel, about the arm pits in the front.

It is contemplated without deviating from the present invention, that other embodiments may employ the midi weighted jacket as presented in FIG. 5, comprising the front panel 16 and shoulder panel 18, with no spaces are provided at the right and left arm pits about the front panel and shoulder panel, as described respectively by area contained in 69, 70 and 68; and 71, 73 and 72. The enclosure still allows the midi weighted jacket to maintain the no sides nature.

Figure 6:
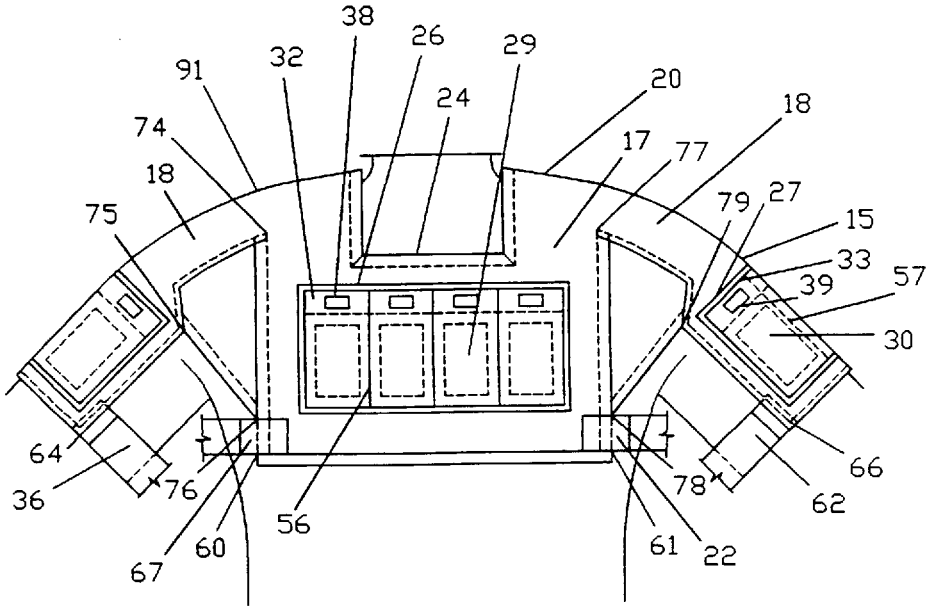
FIG. 6 is a rear view of the midi weighted jacket, with stitched enclosure between the back panel and shoulder panel, about the arm pits in the back.
Figure 7:
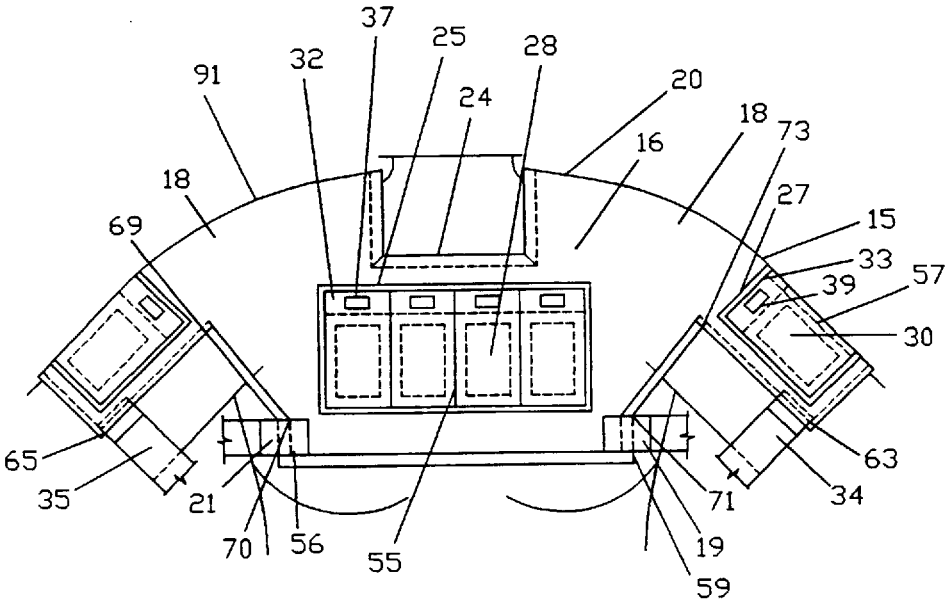
FIG. 7 is a front view of the midi weighted jacket, with integral enclosure between the front panel and shoulder panel, about the arm pits in the front.
Figure 8:
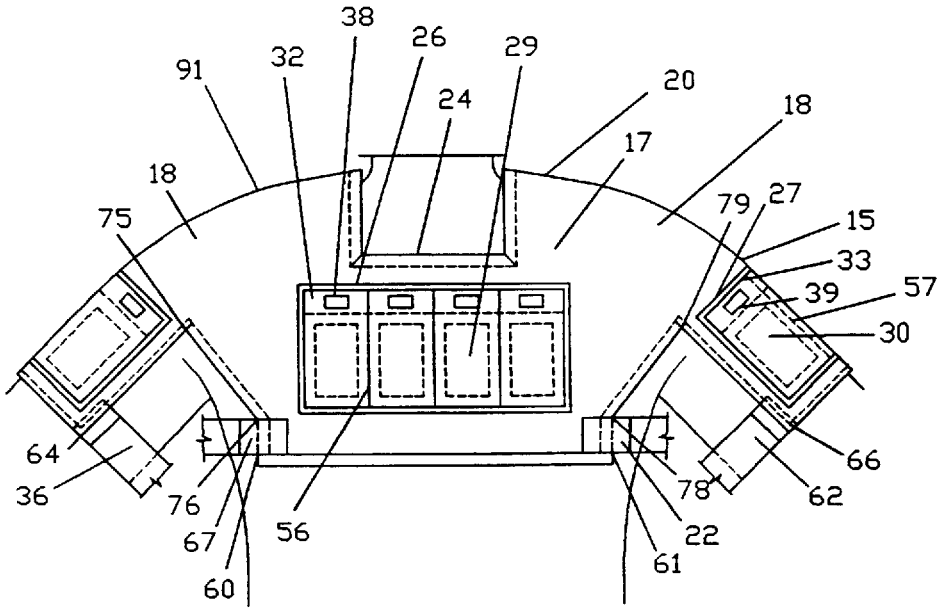
FIG. 8 is a rear view of the midi weighted jacket, with integral enclosure between the back panel and shoulder panel, about the arm pits in the back.

Similarly, as can be seen in FIG. 6, it is also further contemplated and also without deviating from the present invention, that no spaces are provided at the right and left arm pits about the back panel 17 and shoulder panel 18, as described respectively by area contained in 77, 78 and 79 and 74, 76 and 75. The enclosure still allows the midi weighted jacket to maintain the no sides nature.

The descriptions presented in the above embodiments are non restrictive, should be interpreted as illustrative, with no intent to exclude equivalent features , terms and expressions.

We claim:

1. A midi weighted jacket adapted to be worn above the breastline by athletes and healthy persons during various exercises comprising:

a. a front panel, a back panel, and two shoulder panels for improving the physical fitness and general posture of a wearer over time through specific exercises, the jacket having open sides;

b. a plurality of pockets in the front panel, back panel and shoulder panels, with each of the said pockets comprising secured openings for admitting and removing weight packets;

c. a rectangular opening about the neck of the wearer where the front panel integrally connects to the back panel, to facilitate easy access for head and neck entry, during attachment and removal of the said jacket from the shoulders;

d. joining means comprising shoulder pieces that are integrally connected to the front panel and the back panel and are also integrally connected to the shoulder panels;

e. joining means for connecting the front panel and the back panel, said joining means extending across the open sides above and around the bustline;

f. a plurality of weight packets for insertion into said pockets which comprise lead and lead alloy material, which are permanently sealed in enclosed polymer based bags, said bags being completely surrounded and secured by multi-stitched sealed fabric sacks;

g. wherein each said shoulder panel is secured on the arm and placed at the outside of the arm immediately below the deltoid muscle and above the elbow.

2. The midi weighted jacket as in claim 1 wherein each said shoulder panel connected to one of the shoulder pieces by stitching, said shoulder piece connecting the front panel to the back panel.

3. The midi weighted jacket as in claim 1 wherein each said shoulder panel is secured to the arm by a hook and loop fastener.

4. The midi weighted jacket as in claim 1 wherein each said shoulder panel is equipped with a plurality of pockets, which may be oriented vertically, and horizontally.

5. The midi weighted jacket as in claim 1 wherein said pockets are equipped with horizontal or vertical openings for insertion or removal of weights.

6. The midi weighted jacket as in claim 5 wherein said pockets are equipped with means for closure and opening comprising hook and loop fasteners.

7. The midi weighted jacket as in claim 5 wherein said pockets have opening and closing means comprising zippers, buttons, laces, or studs.

8. The midi weighted jacket as in claim 3 wherein the shoulder panel is connected to the shoulder piece, which connects the front panel to the back panel, by zippers, buttons, laces, or studs.

9. The midi weighted jacket as in claim 1 wherein said jacket comprises open sides between the armpit and above the bustline, and wherein the shoulder panel is provided with a means for accommodating weight packets on the outside of, below, and about the deltoids of the shoulder area and above the elbow, in conjunction with the front panel, in which weight packets are located over the chest, between the collar bone and above the bustline, and also in conjunction with the back panel, in which weight packets are also located over the upper back, and just immediately below the trapezoidal muscle.

10. The midi weighted jacket as in claim 1 wherein said joining means for connecting the front panel and the back panel at the region about the bustline comprises a hook and loop fastening mechanism, loops, laces, zippers or studs.

11. The midi weighted jacket as in claim 1 wherein said jacket comprises weight pockets located in the front panel which take the shape of the wearer's body contours.

12. The midi weighted jacket as in claim 1 wherein said jacket comprises weight pockets located in the back panel which take the shape of the wearer's body contours.

13. The midi weighted jacket as in claim 1 wherein said rectangular opening is located at the top of the front panel and the back panel to facilitate easy access of the head and neck during removal of the weighted jacket from the wearer's shoulders.

14. The midi weighted jacket as in claim 2 wherein said weight packets are held snugly close to the wearer's upper body and upper arms, so as to prevent violent shifting of the weight within the said pockets during dynamic exercises.

15. The midi weighted jacket as in claim 1 wherein said jacket improves the wearer's physical capabilities over time by walking, running, jogging, lunging, jumping, skipping, goose walking, punching, blocking and rabbit hopping.

16. The midi weighted jacket as in claim 1 wherein said jacket improves the posture of the wearer when walking, jogging, lunging, running, jumping, skipping, goose walking, punching, blocking and rabbit hopping.

17. The midi weighted jacket as in claim 1 wherein said jacket provides stimulation by virtue of increased loading to the upper pectorial, deltoids, trapezoidal, latimus dorsi and upper back muscles, during dynamic exercises.

18. The midi weighted jacket as in claim 1 wherein the front panel, back panel and shoulder panels, are rectangular or curvilinear.

19. The midi weighted jacket as in claim 1 wherein said front panel, back panel and shoulder panels, are constructed and arranged so as to eliminate any areal spaces about the arm pit regions.

20. The midi weighted jacket as in claim 1 wherein the plurality of pockets are stitched to said jacket, and accommodate said weight packets.

* * * * *